US005429669A

United States Patent [19]

Chang

[11] Patent Number: 5,429,669

[45] Date of Patent: Jul. 4, 1995

[54] ELECTROSTATIC PRECIPITATOR

[76] Inventor: Chin-Chu Chang, No. 243, Sec. 2, Feng Shih Road, Feng Yuan City, Taichung Hsien, Taiwan

[21] Appl. No.: 273,797

[22] Filed: Jul. 12, 1994

[51] Int. Cl.[6] ..... B03C 3/74

[52] U.S. Cl. ..... 96/51; 95/76; 96/94

[58] Field of Search ..... 96/51, 28, 33, 39, 40, 96/94, 86, 87; 95/76, 77, 74; 55/296

[56] References Cited

U.S. PATENT DOCUMENTS

| | | | |
|---|---|---|---|
| 1,394,771 | 10/1921 | Kennard | 96/40 |
| 2,631,687 | 3/1953 | Dohrer | 96/40 |
| 3,929,436 | 12/1975 | Kim et al. | 96/51 |
| 5,084,077 | 1/1992 | Junker et al. | 96/39 |

*Primary Examiner*—Richard L. Chiesa

*Attorney, Agent, or Firm*—Morton J. Rosenberg; David I. Klein

[57] ABSTRACT

An electrostatic precipitator including an ionization unit for ionization to charge the oily dust particles in the air flowing therein at the front, a dust precipitating unit for catching the charged oil dust particles in the air flowing from the ionization unit thereinto at the front and out therefrom at the back by means of an electrostatic field produced from a plurality of large and small electric plates reversed in conductivity, a plurality of scrapers respectively mounted in between respective two adjacent large and small electric plates for scraping away the oily dust particles precipitated on the large and small electric plates, and a collecting unit located underneath the dust precipitating unit for collecting the oily dust particles scraped away by the scrapers.

7 Claims, 5 Drawing Sheets

ELECTROSTATIC PRECIPITATOR

BACKGROUND OF THE INVENTION

The present invention relates to an electrostatic precipitator which may make use of a plurality of scrapers to remove the oily dust particles precipitated on respective rotatable electric plates, In conventional electrostatic precipitators, oily dust particles are often adhered to electric plates by their own viscosity after a charge neutralization. When such particles are accumulated on electric plates to form a layer of oil matter over a period of time, the cleaning thereof is usually by patting or water wash. However, patting is not workable, while water wash must use a detergent. As regular detergents are unable to entirely decompose such oil matter, which will be mixed with water during the process of water wash, and then discharged into the sea through the sewage system, thus causing a secondary pollution. Besides, after water wash, electric plates shall not be re-used until they are entirely dried. It is time consuming and often needs a stand-by precipitator, thereby increasing the cost.

SUMMARY DESCRIPTION OF THE INVENTION

The present invention has been accomplished under the aforesaid circumstances. It is therefore the main object of the present invention to provide an electrostatic precipitator which is equipped with a plurality of scrapers for scraping away the oily dust particles precipitated on electric plates, and such particles thus scraped away can be collected by a collecting unit for disposal to prevent from a secondary pollution.

DETAILED DESCRIPTION OF THE PREFERRED EMBODIMENT

Figure 1:
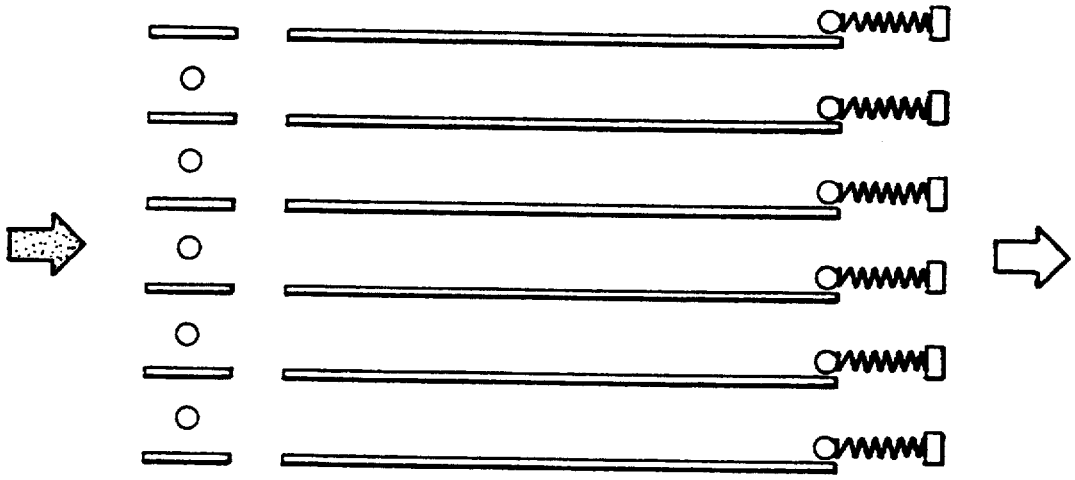
FIG. 1 PRIOR ART
FIG. 1 is a plan view of a prior art precipitator.
Figure 2:
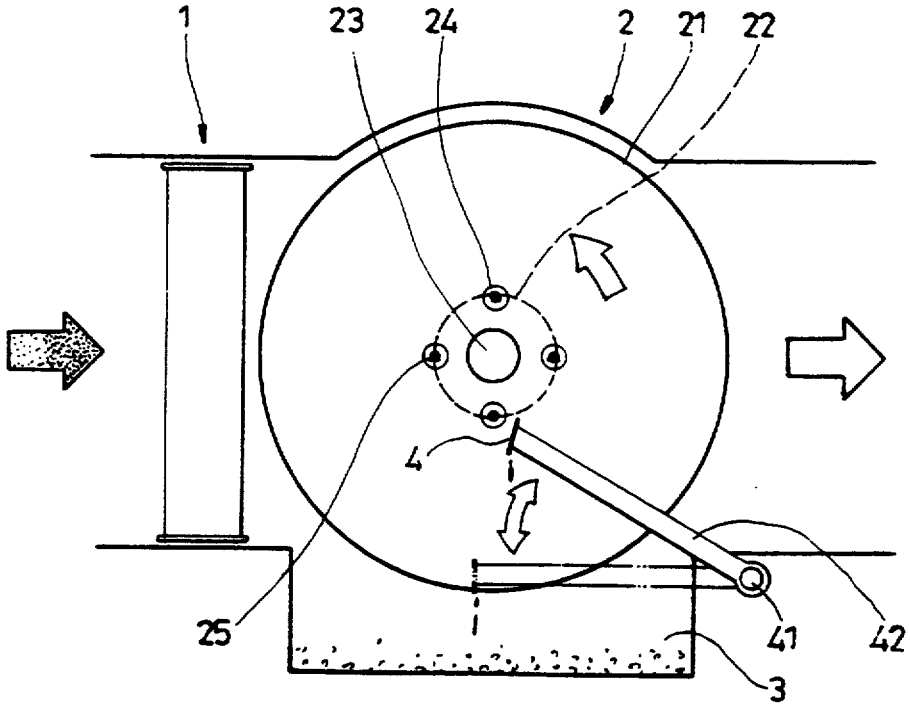
FIG. 2 is a plan view showing a preferred embodiment of an electrostatic precipitator according to the present invention.
Figure 3:
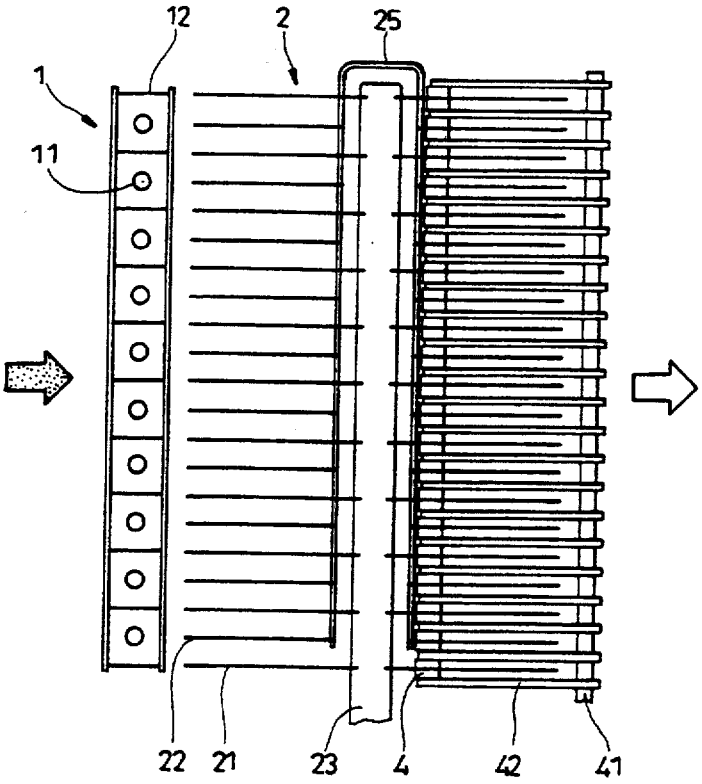
FIG. 3 is a sectional view of the electrostatic precipitator of FIG. 2.
Figure 4:
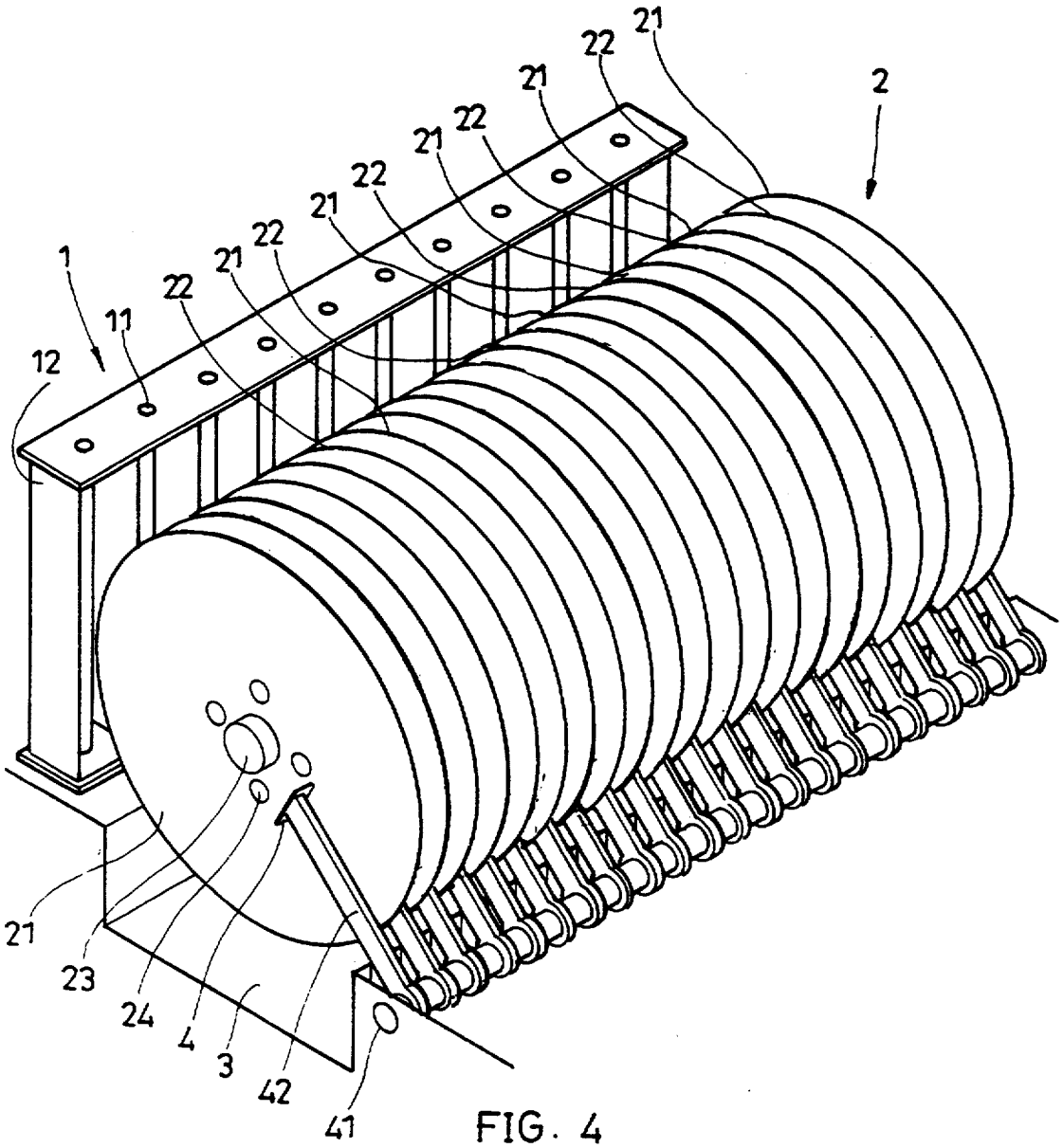
FIG. 4 is a perspective view of the electrostatic precipitator of FIG. 2.

Referring to FIGS. 2 to 4, an electrostatic precipitator in accordance with the present invention is generally comprised of an ionization unit 1, a dust precipitating unit 2, a collecting unit 3, and a plurality of scrapers 4.

The ionization unit 1 comprises a plurality of metal wires for discharge of applied high voltage D.C. power and a plurality of metal ground plates 12 arranged in parallel with each other. The dust precipitating unit 2 comprises pairs of large and small electric plates 21, 22 reversed in conductivity and alternatively disposed in parallel at equal interval, wherein the large electric plates 21 are connected to positive electricity and mounted on a rotary shaft 23, each having four holes 24 spaced around the axis thereof at equal distance through which negative conductors 25 pass to connect with the small electric plates 22 in such a manner that does not contact the large electric plates 21. The air flowing in the dust precipitating unit 2 through the ionization unit 1 can flow out at the back of the dust precipitating unit 2. Each scraper 4 is mounted on a respective driving bar 42 disposed between a pair of large and small electric plates 21, 22 and connected to a swing link 41 for being driven thereby. When both sides of scrapers 4 respectively contact the adjacent large and small electric plates 21, 22 to remove the oily dust particles precipitated thereon, the particles thus removed are collected by a collecting unit 3 located underneath the dust precipitating unit 2.

With such an arrangement, when oily dust particles enter in the ionization unit 1, they are ionized to become charged particles and then enter in an electrostatic field produced by large and small electric plates 21, 22, making them attracted thereto by the action of coulombian force.

Over a period of time, electric plates 21, 22 would be covered by a layer of oily dust particles precipitated thereon, thus weakening the coulombian force of the electrostatic field and losing the function to attract charged oily dust particles. Under the circumstances, it is required to remove the oily dust particles thus precipitated in order to resume the working efficiency.

By starting the rotary shaft 23 and the swing link 41 in the dust precipitating unit 2, the scrapers 4 on respective driving bars 42 will be driven to scrape away the oily dust particles thus precipitated. As large and small electric plates 21, 22 in the dust precipitating unit 2 are coaxially rotated, and the scrapers 4 disposed therebetween can make a sector swing motion from the axis thereof towards the periphery, the route of swing motion made by the scrapers 4 would, in cooperation with the rotation of the dust precipitating unit 2, substantially cover the entire dust precipitating surfaces on the electric plates 21, 22, thus enabling the scrapers 4 to remove the oily dust particles precipitated on electric plates 21, 22 at the same time when they move along the swing route, and the oily dust particles thus removed would fall into the collecting unit 3 by their own weight for disposal to prevent the occurrence of secondary pollution.

Figure 5:
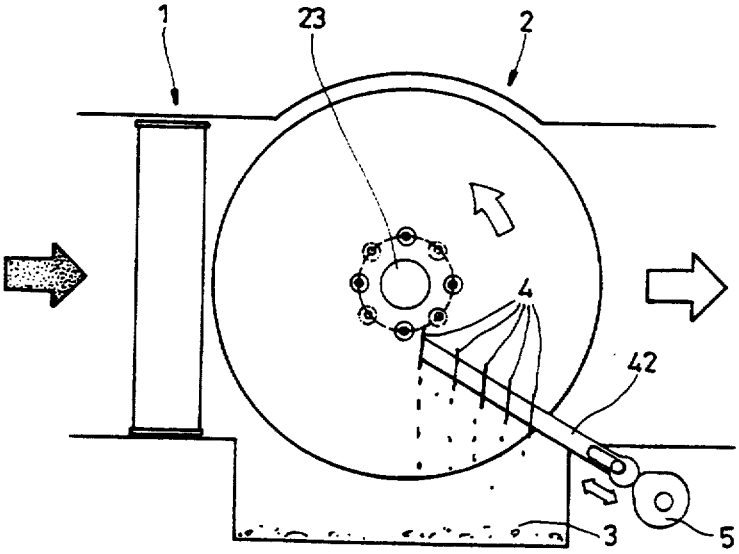
FIG. 5 is a plan view showing a modification of the electrostatic precipitator of FIG. 2.

Referring to FIG. 5, therein illustrated is a modification of the present invention comprising a plurality of scrapers 4 spaced along a driving bar 42 at a predetermined interval. Each scraper 4 is designed to remove the oily dust particles precipitated on a specific circle of area on the large or small electric plates 21. 22 whose entire dust precipitating surface is then covered by the combination of these scrapers 4. By a cam mechanism 5, the driving bar 42 can make a linear reciprocating movement between the axis of electric plates 21 or 22 and the periphery thereof, helping increase the scraping area of the scrapers 4 to assure a better scraping effect.

It is understood that such plurality of scrapers 4 could be replaced by an elongated one-piece scraper 6 having a continuous cutting edge or a plurality of discontinuous cutting edges spaced thereon.

Figure 6:
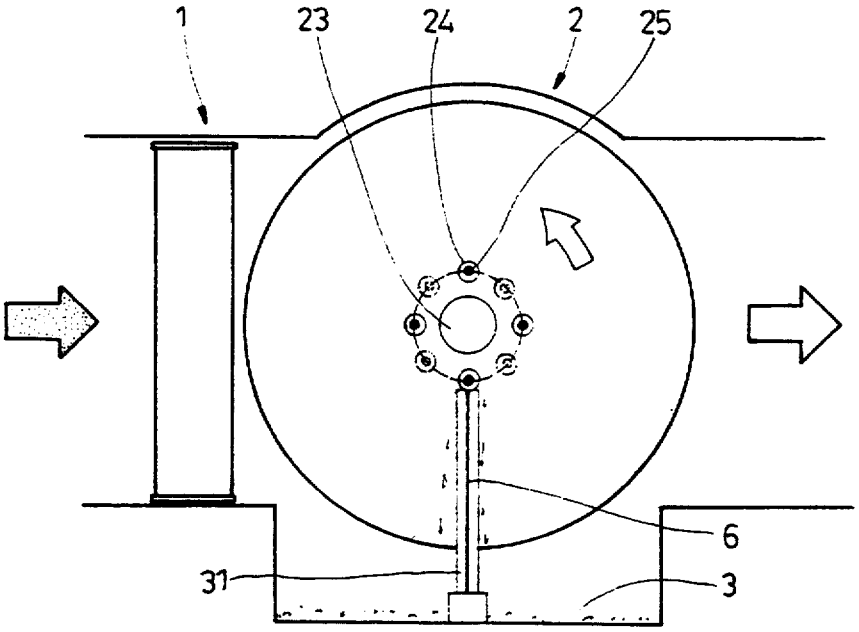
FIG. 6 is a plan view showing another modification of the electrostatic precipitator of FIG. 2.

FIG. 6 shows another modification, in which an elongated one-piece scraper 6 is mounted on a fixed post 31 in the collecting unit 3. When the dust precipitating unit 2 is rotated making the electric plates 21, 22 passed over the scraper 6, the oily dust particles precipitated thereon are then removed by the scraper 6.

Figure 7:
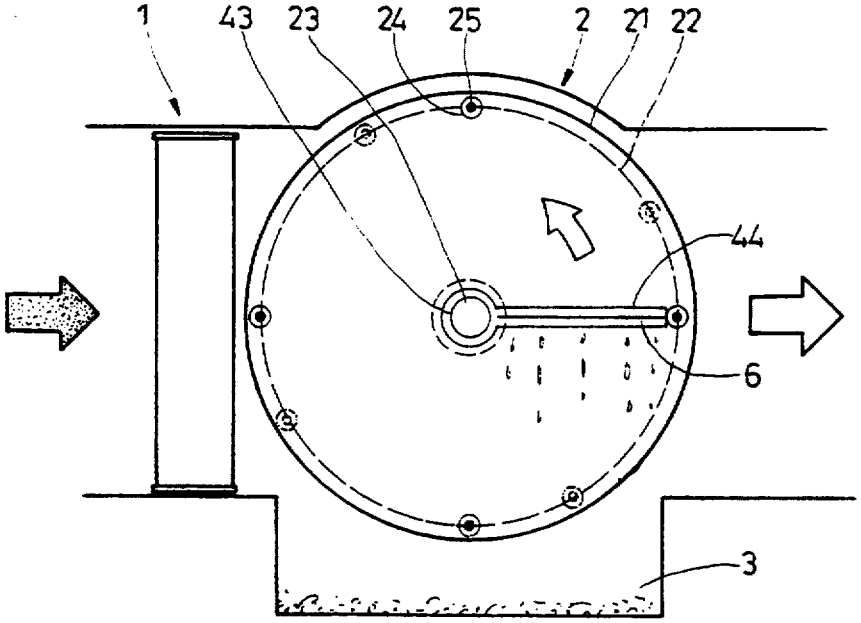
FIG. 7 is a plan view showing still another modification of the electrostatic precipitator of FIG. 2.

Referring to FIG. 7, therein illustrated is still another modification having four holes 24 spaced on either of large electric plates 21 around the periphery, and a driving shaft 43 may be additionally mounted in between large and small electric plates 21, 22 for connecting to a driving bar 44 of the scraper 6, which driving shaft 43 and the rotary shaft 23 are coaxial but are respectively driven by two different driving sources. When the driving shaft 43 is rotated, the scraper 6 on the driving bar 44 is carried to rotate for removing the oily dust particles precipitated on the electric plates 21, 22.

Figure 8:
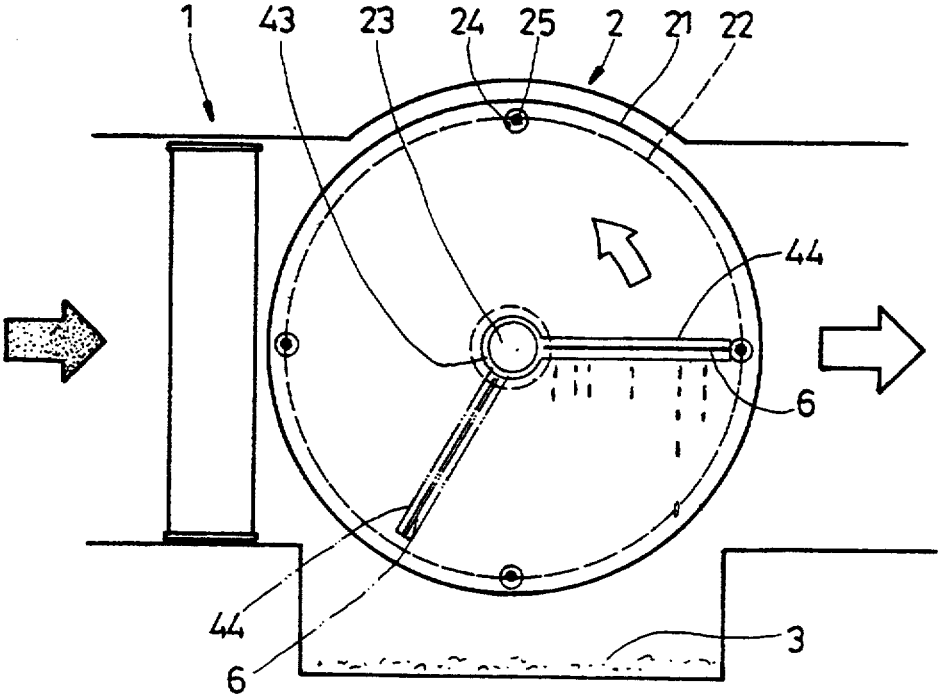
FIG. 8 is a plan view showing still another modification of the electrostatic precipitator of FIG. 2.

FIG. 8 shows a modification of FIG. 7, in which the driving shaft 43 is fixed holding the scrapers 6 on the driving bars 44 still, so as to remove the oily dust particles precipitated on the electric plate 21, 22 by the rotation of the dust precipitating unit 2.

Figure 9:
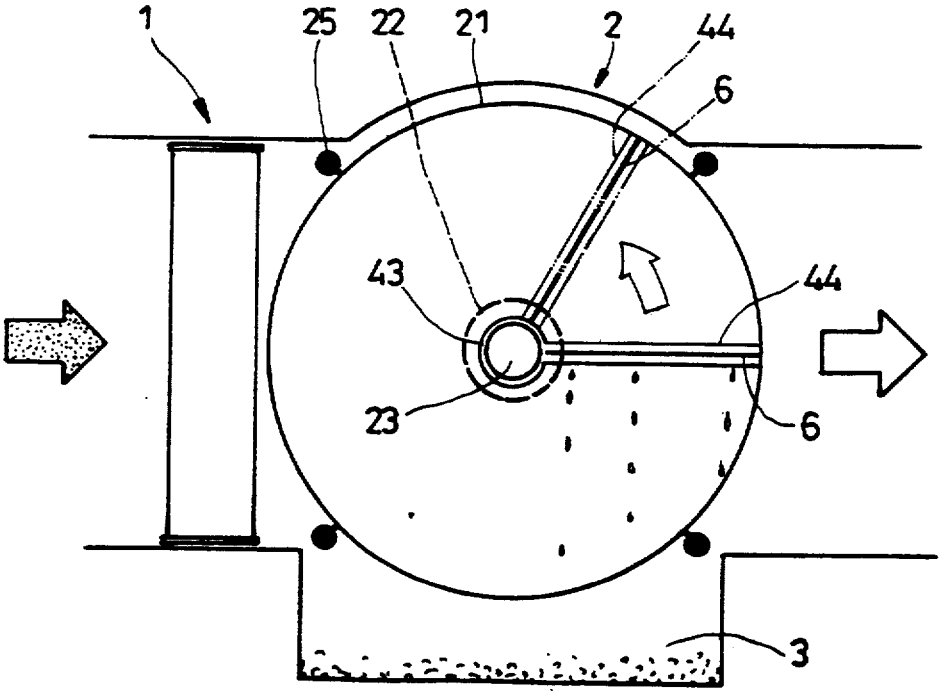
FIG. 9 is a plan view showing still another modification of the electrostatic precipitator of FIG. 2.

In addition, various modifications and changes may be made to the present invention. For example, the holes 25 spaced on either of the large electric plate 21 may be arranged at unequal intervals through which the negative conductors 25 pass to connect with the small electric plates 22; or such negative conductors 25 may be mounted on a coaxial socket in relation to the rotary shaft 23, with an insulating material disposed therebetween to avoid any short circuit. Further, as shown in FIG. 9, the negative conductors 25 may be spaced around the border of either large electric plates 21 having no holes 24 thereon for connecting to the small electric plates 22. Also, either scraper 4 may be designed to contact respective plates 21, 22 only at the time of carrying out the scraping operation, when the scraper 4 may turn at a certain angle holding its cutting edge against the electric plates for scraping off the oily dust particles precipitated thereon. If the scraper 4 is designed to scrape off the precipitated oily dust particles during the operation of dust precipitation, then such scraper 4 must be made from insulating material to avoid any electric conduction.

Moreover, the dust precipitating unit 2 may be otherwise surrounded or covered for protection thereof from deteriorating, and any deformation occurred to the surfaces of electric plates 21, 22 may be corrected for producing a constant electrostatic field.

While several embodiments of the present invention have been shown and described, it is understood that various modifications and changes could be made thereunto without departing the spirit and scope of the claims.

What is claimed is:

1. An electrostatic precipitator, comprising:

an ionization unit comprising a plurality of metal wires for discharge of applied high voltage D.C. power and a plurality of metal ground plates arranged in parallel with each other for ionization to charge the oily dust particles in the air flowing therein at the front;

a dust precipitating unit for catching the charged oil dust particles in the air flowing from said ionization unit thereinto at the front and out therefrom at the back, comprising pairs of large and small electric plates reversed in conductivity and alternatively positioned in parallel at equal interval, either of said large electric plates being connected to a polarity of electricity and mounted on a rotary shaft, having four holes spaced around the axis thereof at equal distance for passing therethrough of respective conductors having an opposite polarity of electricity to connect with said small electric plates in such a manner that does not contact said large electric plates;

a plurality of scrapers respectively mounted in between said pairs of large and small electric plates, with cutting edges against said large and small electric plates respectively for scraping away the oily dust particles precipitated thereon; and a collecting unit located underneath said dust precipitating unit for collecting the oily dust particles scraped away by said scrapers.

2. An electrostatic precipitator as set forth in claim 1, wherein said scrapers are driven by a swing link whose axis is different from that of said rotary shaft in said dust precipitating unit, said swing link driving said scrapers to make a sector swing motion from respective axes of said electric plates towards the periphery thereof, so as to cover the entire dust precipitating surfaces of said respective electric plates by the route of such swing motion when synchronized with the rotation of said dust precipitating unit.

3. An electrostatic precipitator as set forth in claim 1, including a plurality of driving bars having a plurality of scrapers spaced thereon, said scrapers being driven to make a linear reciprocating movement from the respective peripheries of said electric plates to the axes thereof, so as to cover the entire dust precipitating surfaces of said respective electric plates by the route of such linear movement when synchronized with the rotation of said dust precipitating unit.

4. An electrostatic precipitator as set forth in claim 1, wherein either of said scrapers is mounted on a fixed post in said collecting unit for scraping away the oily dust particles precipitated on said respective large and small electric plates when they pass over said scrapers upon rotation of said dust precipitating unit.

5. An electrostatic precipitator as set forth in claim 1, wherein either of said large electric plates comprises four holes spaced around the periphery thereof, and a driving shaft being additionally mounted in between said large and small electric plates for connecting to driving bars of said scrapers for rotating to drive said scrapers bars, thus scraping away the oily dust particles precipitated on said respective electric plates, said driving shaft and said rotary shaft being coaxial but being respectively driven by two different driving sources.

6. An electrostatic precipitator as set forth in claim 1, wherein driving shaft is fixed holding said scrapers on driving bars stationary, so as to remove the oily dust particles precipitated on said large and electric plates by the rotation of said dust precipitating unit.

7. An electrostatic precipitator as set forth in claim 1, wherein said conductors connecting to said small electric plates are mounted on either of said large electric plates and spaced around the border thereof.

* * * * *